United States Patent [19]

Burke

[11] 4,146,459

[45] Mar. 27, 1979

[54] TREATMENT OF COAL LIQUEFACTION EFFLUENT

[75] Inventor: Francis P. Burke, Bethel Park, Pa.

[73] Assignee: Continental Oil Company, Stamford, Conn.

[21] Appl. No.: 861,912

[22] Filed: Dec. 19, 1977

Related U.S. Application Data

[63] Continuation of Ser. No. 721,639, Sep. 8, 1976, abandoned.

[51] Int. Cl.[2] ..... C10G 1/04

[52] U.S. Cl. ..... 208/8; 44/7 R; 44/13; 196/102; 196/114; 196/115; 196/133; 208/10; 208/349; 264/87

[58] Field of Search ..... 208/8, 10, 45, 349; 196/114, 115, 133, 102

[56] References Cited

U.S. PATENT DOCUMENTS

| | | | |
|---|---|---|---|
| 2,060,447 | 11/1936 | Schoenemann | 208/45 |
| 2,489,700 | 11/1949 | Coast | 208/45 |
| 2,768,128 | 10/1956 | Brown | 208/349 |
| 3,808,119 | 4/1974 | Bull et al. | 208/8 |

*Primary Examiner*—Herbert Levine

*Attorney, Agent, or Firm*—F. Lindsey Scott; D. Leigh Fowler, Jr.; William A. Mikesell, Jr.

[57] ABSTRACT

A solvent extraction coal conversion process is provided wherein the effluent slurry product is subjected to vacuum distillation to yield distillate and extrudable still bottoms. The latter are removed from the vacuum still by means of an extrusion screw which is operatively associated with the still.

2 Claims, 1 Drawing Figure

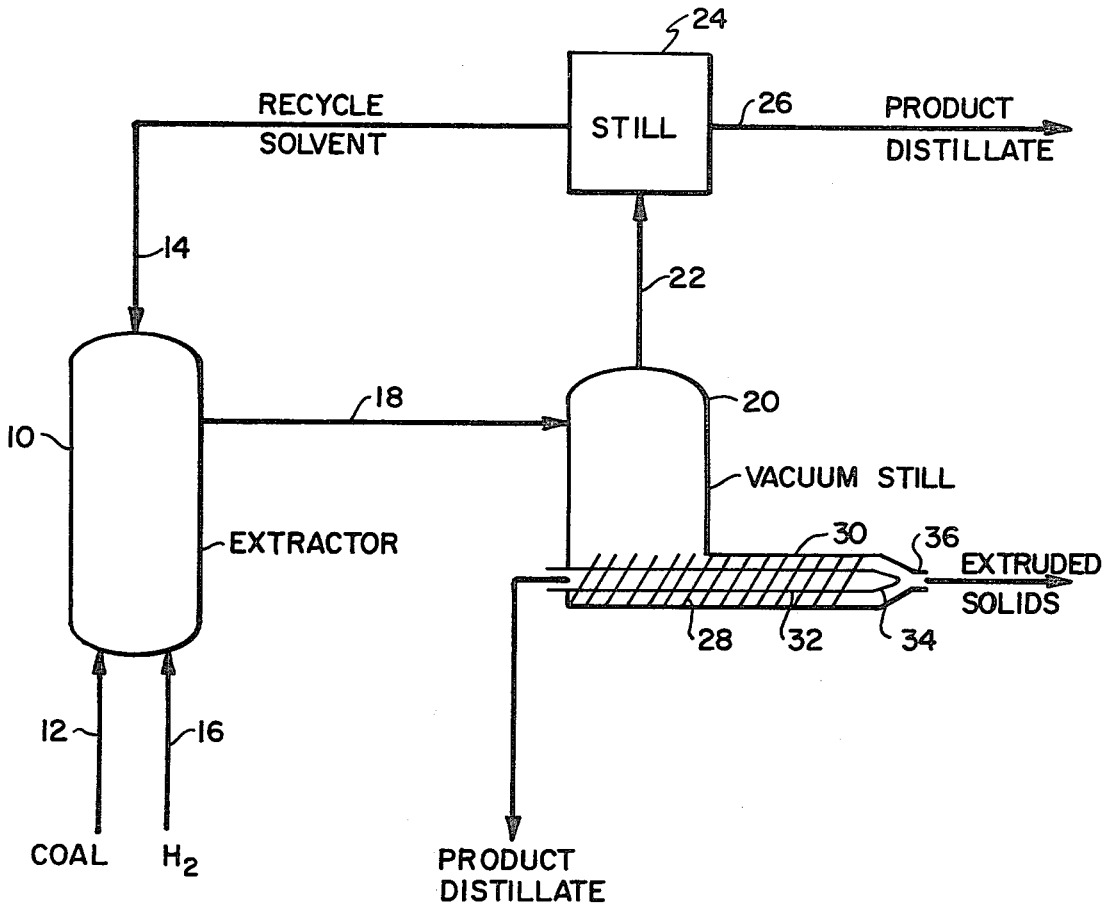
24
RECYCLE
SOLVENT
STILL
26
PRODUCT
DISTILLATE
14
22
18
20
10
VACUUM STILL
EXTRACTOR
30
36
EXTRUDED
SOLIDS
28
32
34
12
16
COAL
$H_2$
PRODUCT
DISTILLATE

TREATMENT OF COAL LIQUEFACTION EFFLUENT

This is a continuation of application Ser. No. 721,639, filed Sept. 8, 1976 and now abandoned.

BACKGROUND OF THE INVENTION

This invention relates to a process and apparatus for the liquefaction of coal, and, more particularly, to the treatment of the effluent obtained by such liquefaction.

In particular, the invention relates to coal liquefaction processes wherein a solvent (hereinafter sometimes called liquefaction solvent) is present during the liquefaction of the coal. Liquefaction may be achieved by hydrogenation, depolymerization, extraction, etc. The liquefaction solvent, which is generally coal-derived, may function as solvent for the coal or for the products, or both. It may also play a reactive role, for instance, in the depolymerization and hydrogenation of the coal molecules. Liquefaction may also be achieved with or without the presence of a catalyst, and with or without the presence of molecular (gaseous) hydrogen, in addition to the liquefaction solvent. Examples of such coal liquefaction processes are described in U.S. Pat. Nos. 3,018,242; 3,177,921; 3,143,489; 3,158,561; 3,523,886; U.S. Pat. No. Re. 25,770; and No. 3,321,393.

The product effluent from such coal liquefaction processes is a mixture of liquid and undissolved solids. Distillation of the effluent will produce three essential product streams. Of the volatile material, part will be recovered as solvent to be recycled to the coal extractor. A second part of the distillate can be considered the product distillate. Further refinement of this product distillate will yield various gaseous or liquid fuels, chemicals, or chemical precursors. The third product is the non-volatile extract and residual solids. This material is suitable as a feedstock for gasification or coking. The difficulty with the solvent extraction coal liquefaction processes lies in the fact that, having removed the lower molecular weight volatiles, the "still bottoms" will comprise a highly viscous and correspondingly intractable material. The viscosity of the material can be reduced by taking a lower distillate cut, but, of course, with a reduction in the net yield of product distillate.

The primary objective of this invention is to provide a method and apparatus for handling the still bottoms which will both maximize the distillate yield, and produce a solid product useful as a gasifier or coker feedstock.

The following patents were considered in the preparation of this application: U.S. Pat. No. 2,060,447, and South African Pat. No. 75/0044.

SUMMARY OF THE INVENTION

I conceived the following invention in order to achieve the foregoing primary objective. The extraction effluent slurry from a solvent coal extraction vessel is conducted to a vacuum still. Operatively associated with the vacuum still is a heatable screw, preferably an extrusion-type screw. The vacuum still acts as a feed hopper for the screw which is hollow, with vent holes near the outlet, so that a final distillate cut may if desired be made within the screw itself. The conditions of temperature and pressure within the vacuum still are chosen so that the viscosity of the still bottoms is sufficiently low to permit its removal from the still by means of the screw. The conditions of temperature and pressure within the screw are preferably chosen to permit a deeper distillation. At the outlet of the screw, the temperature, if desired, may be reduced and the product cooled to form a solid.

My invention offers three principal advantages: (1) conveyance of the viscous still bottoms from the vacuum still, (2) maximized distillate yield as a result of the distillation within the screw, and (3) rejection of the non-volatile material as an easily handled solid.

DESCRIPTION OF THE DRAWING

The drawing is a schematic flowsheet of the preferred embodiment of the present invention.

GENERAL

The coal conversion processes to which the present invention is considered applicable are those which use a liquefaction solvent in the conversion of coal. The solvent-to-coal weight ratio is generally between 1 and 4.

Coal as used herein means any form of naturally occurring solid, ash-containing, hydrocarbonaceous substance, and includes, by way of example, bituminous and sub-bituminous coals, anthracite, and lignites.

A suitable liquefaction solvent is a mixture of polycyclic aromatic hydrocarbons which is liquid under the conditions of temperature and pressure maintained during coal liquefaction. A suitable normal boiling range for such a solvent for example, is within the range 250 to 425° C. The solvent may be conveniently derived as a distillate fraction in the overall coal liquefaction process; in other words, from the coal itself. Preferably, at least a portion of the aromatic hydrocarbons is hydrogenated to provide a hydrogen transfer solvent.

The selected liquefaction process may be any of the processes commonly used by those skilled in the art, exemplified by those described in the first above-cited group of patents. The process may be continuous, batch, countercurrent, cocurrent, or staged; and may use fixed beds, fluidized beds or ebullating beds, for example. The temperature at which the coal liquefaction is conducted generally lies between 300 and 500° C. The pressure may be selected over a wide range, e.g. between 1 and 6500 psig. The residence time, too, varies widely, but is generally in the range of 1 to 120 minutes, being dictated by the other conditions as well as the desired extent of liquefaction. To attain depths of coal conversion between 50 and 80 percent or so of the moisture-and-ash-free coal, the addition of hydrogen is generally required, either by hydrogen transfer from the liquefaction solvent or extraneously, or both.

After liquefaction of the coal has been satisfactorily achieved, the effluent slurry product is conducted to a vacuum still. At this point, this product consists essentially of a solution of the coal liquefaction product in the liquefaction solvent and the undissolved solids. Generally, no attempt is made to separate the readily separable coarse solids since each such separation entails added cost and some loss of desired product. Furthermore, the larger particles may actually contribute to the extrudability of the still bottoms. The vacuum still is maintained under such conditions of temperature and pressure that an extrudable material is produced as the still bottoms. Generally the temperature will be in the range equivalent to 200 to 600° C. at one atmosphere. The extrudable material so produced may be considered to be thermoplastic; that is, it is a hard, brittle solid at room temperature, and exhibits a softening (glass transition) at elevated temperatures. Thus, I believe it may be handled in a manner customary and apropriate to visco-elastic materials, including but not limited to vacuum extrusion.

The viscous still bottoms are conducted by the screw from the still which serves as a feed hopper in direct open communication with the screw. In fact, it is preferred that the screw housing be an integral part of the still at the bottom thereof. The screw, however, may be heated if desired to a temperature higher than that maintained in the still, to thereby effect further distillation of the still bottoms. The screw is provided with suitably located vents or openings for the escape of the distillate from the hollow core of the screw.

The principal product issuing from the screw may be solidified, if desired, by reduction in temperature. This product may then be pelletized by appropriate means. The resulting pellets may be used as non-caking feed to fixed bed gasifiers or cokers. If further hardening is desired before such uses, then the pellets may be subjected to heat treatment at higher temperatures than those maintained in the screw. In some instances, rather than cooling the product from the screw, the product may be fed directly to a fluid coker.

PREFERRED EMBODIMENT

The drawing illustrates the preferred embodiment of this invention in conjunction with a particular coal liquefaction step. Coal is crushed to a size wherein most of the coal is less than 8 mesh U.S. Sieve Series, and is largely in the size range between 40 and 200 mesh. The crushed coal is usually dried and preheated first, although the drier and preheater are not shown.

The coal and liquefaction solvent are fed to an Extractor 10 through conduits 12 and 14 respectively. In actual practice, the coal and solvent are premixed to form a slurry which is readily introduced into a high pressure reactor.

The liquefaction solvent is preferably one which has a normal boiling point in excess of 250° C. and is a hydrocarbon oil which consists essentially of partially hydrogenated dicyclic and polycyclic hydrocarbons, including naphthenic hydrocarbons, that are liquid under the temperature and pressure maintained in the Extractor. Such a solvent may be readily derived from intermediate or final steps of the liquefaction process. The ratio of liquefaction solvent to coal is between 1 and 4.

In the Extractor, the coal solids undergo liquefaction. This liquefaction is accomplished in the presence of molecular hydrogen and a suitable hydrogenation or hydrocracking catalyst. A hydrogen-containing gas is introduced into the Extractor by way of a hydrogen inlet line 16 which may consist of several inlets appropriately spaced. The Extractor is operated under conditions at which a major portion of the coal solids rapidly undergoes conversion to liquid and gaseous products. Those conditions include a temperature between 500° F. and 1000° F. and a total pressure between 500 and 5000 psig. The preferred temperature range is between 725° F. and 875° F., depending upon the activity of the catalyst and the residence time of the reactants. The partial pressure of molecular hydrogen in the Extractor is between 400 and 4000 psig. Hydrogen is injected into the Extractor at a rate sufficient to maintain this hydrogen partial pressure and the desired amount of hydrogen in solution in the liquids in the Reactor. Generally, the injection rate is in the range between 6,000 and 75,000 standard cubic feet (s.c.f.) per U.S. ton of reactants charged to the Extractor. The rate of coal charged per effective cubic foot of Extractor volume is between 15 and 250 pounds per hour. A preferred type of Extractor is the ebullated bed (described in U.S. Pat. No. Re. 25,770) and the preferred coal charge rate per cubic foot is in the range between 15 and 200 pounds per hour. The ratio of the coal feed rate to catalyst on a volume basis is in the range between 0.5 and 5.0. The catalyst size is in the range between 200 mesh and 3 mesh.

In the Extractor, coal solids, liquefaction solvent, hydrogen and catalyst are in intimate association in the slurry phase of the ebullated bed. At Extractor conditions, when the solid coal liquefies, hydrogen aids fixing and stabilization of the molecules. This liquefaction of a major portion of the coal is aided by the presence of the liquefaction solvent. The hydrogen consumption to simply fix the molecules at the time of liquefaction depends upon the convertible carbon content of the coal and has been estimated to be less than 1.5 pounds of hydrogen per 100 pounds of coal solids. Additional hydrogen is consumed in partially hydrogenating Extractor liquids and in hydrocracking. In a hydroconversion process such as the present one, the hydrogen consumption will range between 0.5 pound and 15 pounds per hundred pounds of reactant.

Solids-laden liquids are withdrawn from the Extractor by the way of effluent line 18 and introduced into a vacuum still 20. Any vapors in the Extractor are removed from the Extractor by a suitable gas effluent line (not shown). The vapors contain molecular hydrogen and light or low boiling materials. The solids-laden liquids consist essentially of two components. The first component is a combination of low boiling and middle boiling hydrocarbon liquids. The second component consists essentially of still bottoms, that is, the residuum materials boiling above 975° F. and essentially all the undissolved coal solids. It is the function of the vacuum still 20 to separate these two components.

The first and distillable component is withdrawn as overhead from the vacuum still 20 through a line 22 to a fractionating still 24. In this still, the solvent is recovered and recycled through line 14 to the Extractor 10. The remainder is withdrawn through line 26 as product distillate for use per se as fuel or for further refinement or treatment to make fuels of desired specifications.

The second component, the still bottoms, flows into one end of a vacuum extrusion screw 28 which has a housing 30 integral with the walls of the vacuum still and a screw member 32. The latter has a central hollow core member 34. The extrusion screw 28 is adapted to heat by heating elements (not shown) to maintain the desired temperature which is selected to keep the bottoms in an extrudable state and also to effect further distillation of the bottoms. The resulting distillate is removed near the outlet of the screw through the hollow core 34 to the opposite end of the screw member. The extrudate is discharged through outlet 36. Normally the extrudate would be immediately reduced in temperature, to thereby solidify in the form of a rod which may be cut into pellets of predetermined size. These pellets may be used as feedstock either to a fixed bed gasifier or a coker. If need be, they may just be subjected to thermal treatment to improve their strength and resistance to abrasion.

According to the provisions of the patent statutes, the principle, preferred construction and mode of operation of the invention have been explained and what is considered to represent its best embodiment has been illustrated and described. However, it should be understood that, within the scope of the appended claims, the invention may be practiced otherwise than as specifically illustrated and described.

I claim:

1. The process of coal hydroconversion which comprises, in combination, the following steps:

(a) subjecting the coal to extraction with a coal liquefaction solvent in an ebullated bed in an extractor under coal liquefaction conditions in the presence of molecular hydrogen and a catalyst, whereby a major portion of the coal undergoes conversion to liquid and gaseous products;

(b) withdrawing solids-laden liquids from said extractor and introducing said solids-laden liquids into a vacuum still, said solids-laden liquids consisting essentially of two components, the first being a combination of low boiling and middle boiling hydrocarbon liquids, and the second consisting essentially of residuum materials and essentially all the undissolved coal;

(c) separating said two components in said vacuum still by distillation therein under vacuum;

(d) flowing said second component into one end of a vacuum extrusion screw which has a housing integral with the walls of said vacuum still, and a screw member with a central hollow core;

(e) heating said extrusion screw to maintain the temperature required to keep said second component in an extrudable state and to effect further distillation of said second component;

(f) removing the resulting distillate of step (e) through said hollow core;

(g) discharging extrudate through the outlet of said screw;

(h) reducing the temperature of said extrudate to solidify same into a rod; and (i) cutting said rod into pellets of predetermined size.

2. In a coal conversion process wherein coal is subjected to extraction in an extractor with a solvent under coal liquefaction conditions to produce an effluent slurry product, said effluent slurry product being passed to vacuum distillation in a vacuum still to separate a combination of low boiling and middle boiling hydrocarbon liquids from thermoplastic extrudable residuum materials and undissolved coal, said residuum materials and said undissolved coal being recovered as the still bottoms, the improvement comprising: removing said residuum materials and said undissolved coal from the bottom of said still with an extrusion screw to produce extrudates of said residuum materials and said undissolved coal wherein said extrusion screw includes a hollow vented screw means and wherein said extrusion screw is heated to further distill additional quantities of low and middle boiling hydrocarbons from said still bottoms via said hollow screw as said bottoms are extruded.

* * * * *